US005632249A

United States Patent [19]

Sadakane et al.

[11] Patent Number: 5,632,249

[45] Date of Patent: May 27, 1997

[54] AIR FLOW CONTROL DEVICE OF ENGINE

[75] Inventors: Shinji Sadakane, Susono; Hiroki Ichinose, Fujinomiya, both of Japan

[73] Assignee: Toyota Jidosha Kabushiki Kaisha, Aichi, Japan

[21] Appl. No.: 667,253

[22] Filed: Jun. 20, 1996

[30] Foreign Application Priority Data

Jun. 22, 1995 [JP] Japan ..... 7-155933

[51] Int. Cl.[6] ..... F02M 7/00

[52] U.S. Cl. ..... 123/442; 123/336

[58] Field of Search ..... 123/442, 339.1, 123/339.12, 339.23, 179.16, 179.18, 336

[56] References Cited

U.S. PATENT DOCUMENTS

| | | | |
|---|---|---|---|
| 4,484,551 | 11/1984 | Choma et al. | 123/442 |
| 4,487,185 | 12/1984 | Yokoyama et al. | 123/442 |
| 4,700,676 | 10/1987 | Harashima et al. | 123/339.23 |
| 4,718,383 | 1/1988 | Fujisawa | 123/442 |
| 4,768,486 | 9/1988 | Koike et al. | 123/442 |
| 4,796,579 | 1/1989 | Wolfe et al. | 123/336 |
| 4,892,076 | 1/1990 | Toshimits et al. | 123/442 |
| 4,995,364 | 2/1991 | Kamei et al. | 123/442 |
| 5,520,146 | 5/1996 | Hrovat et al. | 123/336 |
| 5,526,789 | 6/1996 | Stein et al. | 123/442 |

FOREIGN PATENT DOCUMENTS

| | | |
|---|---|---|
| 61-19968 | 1/1986 | Japan . |
| 63-143349 | 6/1988 | Japan . |
| 1119874 U | 8/1989 | Japan . |
| 6-229353 | 8/1994 | Japan . |

OTHER PUBLICATIONS

Ser. No. 08/515439 Co-pending US application filed Aug. 15, 1995.

Ser. No. 08/515883 Co-pending US application filed Aug. 16, 1995.

*Primary Examiner*—Raymond A. Nelli

*Attorney, Agent, or Firm*—Kenyon & Kenyon

[57] ABSTRACT

An air flow control device of an engine comprising an air flow control valve arranged in the intake passage and actuated by the vacuum operated diaphragm type drive apparatus. At the cranking of the engine, the air flow control valve is held in the closed state. When the engine speed exceeds a predetermined engine speed, for example, 400 rpm, a valve open signal for the air flow control valve is given to the vacuum operated diaphragm type drive device. After the valve open signal is given, during the valve opening delay period of the air flow control valve, an opening area of the idling speed control valve is increased.

21 Claims, 8 Drawing Sheets

AIR FLOW CONTROL DEVICE OF ENGINE

BACKGROUND OF THE INVENTION

1. Field of the Invention

The present invention relates to an air flow control device of an engine.

2. Description of the Related Art

Most of the unburned hydrocarbons emitted from an engine during its operation from when the engine is started to when the engine is stopped are emitted at the start of the engine. Accordingly, in order to reduce the amount of emission of the unburned hydrocarbons during engine operation, it becomes necessary to reduce the amount of emission of the unburned hydrocarbons at the start of the engine. Usually, in an engine, however, a large volume portion such as a surge tank is provided downstream of the throttle valve. As a result, at the time of cranking, the area downstream of the throttle valve is maintained at substantially atmospheric pressure. In other words, at the time of cranking of the engine, a large amount of air is fed into the engine cylinders like at the time of a high load operation. Accordingly, at the time of cranking of the engine, a large amount of fuel corresponding to this large amount of air is fed, so a large amount of unburned hydrocarbons are generated. In this case, if the amount of intake air fed into the engine cylinders can be reduced at the time of cranking of the engine, the amount of feeding of fuel can be reduced as well and thus the amount of emission of the unburned hydrocarbons can be reduced.

There is a known engine in which the amount of intake air fed into the engine cylinders is reduced at the time of cranking of the engine (refer to Japanese Unexamined Utility Model Publication (Kokai) No. 1-119874). In this engine, an air flow control valve is arranged in the intake passage downstream of the throttle valve. The air flow control valve is driven by a vacuum operated diaphragm type drive device. At the time of cranking of the engine, the air flow control valve is held in the closed state by the vacuum operated diaphragm type drive device. When the engine speed starts to rise and it exceeds a predetermined engine speed, a valve open signal for the air flow control valve is given to the vacuum operated diaphragm type drive device, and the air flow control valve is opened. In this engine, since the air flow control valve is held in the closed state at the time of cranking of the engine, the amount of intake air fed into the engine cylinder is reduced.

In such a vacuum operated diaphragm type drive device, however, there is a operating delay, that is, there is a constant time delay from when the valve open signal for the air flow control valve is given to when the air flow control valve actually opens. As a result, during the delay period in which the air flow control valve is held in the closed state, the amount of intake air fed into the engine cylinder is suppressed, and accordingly the engine speed does not rise so much. The engine speed first rises up to the target engine speed only when the air flow control valve opens. Namely, there is a problem in that a good feeling of engine start cannot be obtained since the engine speed rises in stages at the start of the engine.

Further, since the target engine speed at the time of start of the engine is set near the lower limit engine speed with which a good combustion is obtained, the combustion becomes unstable during a period in which the engine speed does not reach the target engine speed due to the valve opening delay of the air flow control valve. As a result, there arises a problem in that not only is the amount of emission of the unburned hydrocarbons increased, but also an extremely large amount of unburned hydrocarbons is emitted if misfiring occurs in any cylinder.

SUMMARY OF THE INVENTION

An object of the present invention is to provide an air flow control device of an engine capable of smoothly increasing the engine speed while suppressing the amount of unburned hydrocarbons emitted into the outside air when the engine is started.

According to the present invention, there is provided an air flow control device of an engine having an intake passage comprising a throttle valve arranged in the intake passage; an air flow control valve arranged in the intake passage downstream of the throttle valve; drive means for driving the air flow control valve; control means for controlling the drive means to retain the air flow control valve in a closed state when the cranking operation of the engine is carried out and to give a valve open signal for the air flow control valve to the drive means when the engine speed exceeds a predetermined speed; the drive means opening the air flow control valve when a predetermined time has elapsed after the valve open signal is given to the drive means due to the delay of action of the drive means; and flow area increasing means for increasing a flow area of an air flow passage by which air is fed into the intake passage downstream of the throttle valve until the predetermined time has elapsed after the valve open signal is given to the drive means.

BRIEF DESCRIPTION OF THE DRAWINGS

The present invention may be more fully understood from the description of preferred embodiments of the invention set forth below, together with the accompanying drawings, in which.

DESCRIPTION OF THE PREFERRED EMBODIMENTS

Figure 1:
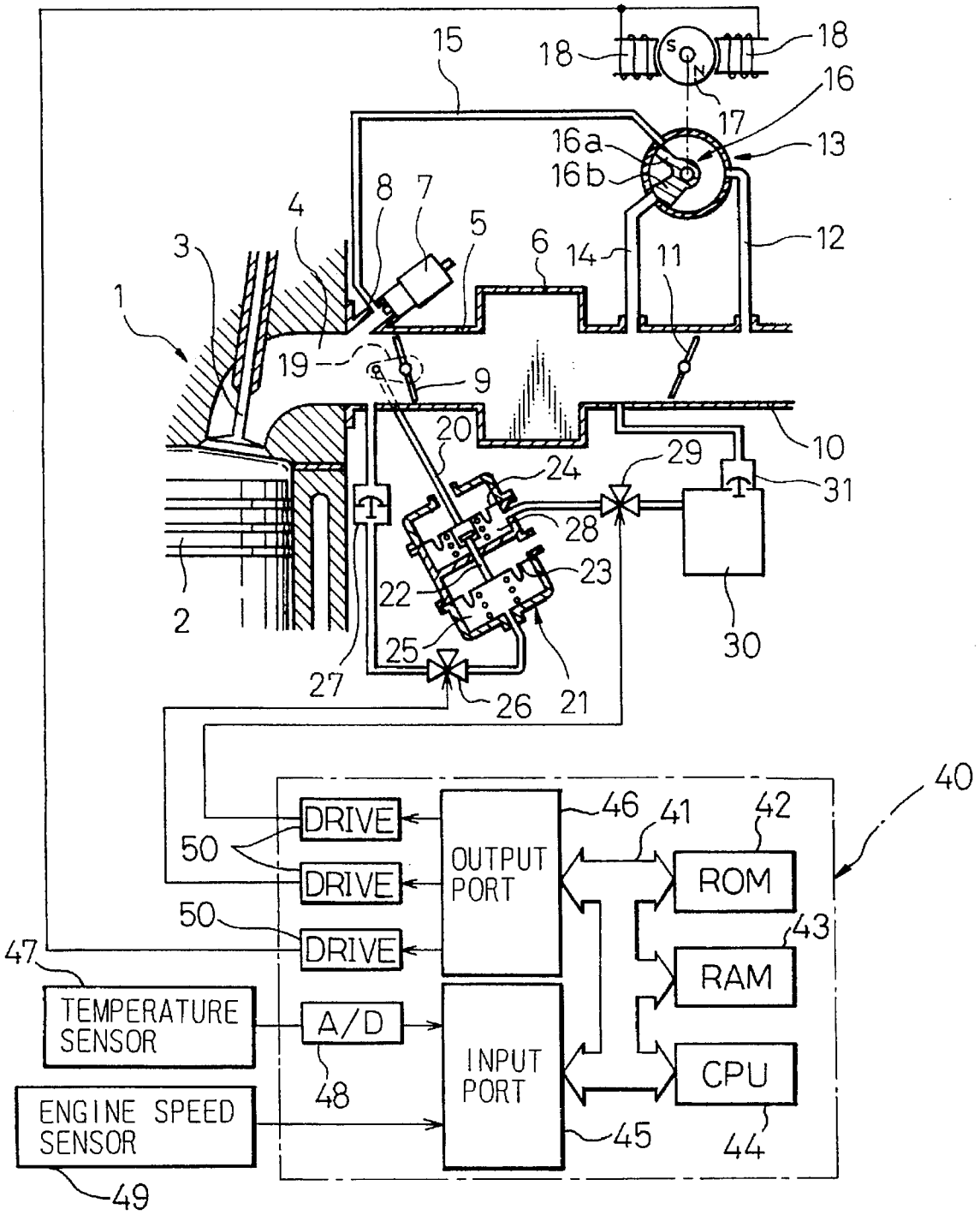
FIG. 1 is an overall view of an engine.

Referring to to FIG. 1, 1 denotes an engine body, 2 a piston, 3 an intake valve, and 4 an intake port. The intake ports 4 of the cylinders are connected to a surge tank 6 via corresponding intake branch pipes 5. A fuel injector 7 injecting fuel toward the interior of the corresponding intake port 4 is attached to each intake branch pipe 5. An assist air feeding port 8 is arranged sideward of the nozzle port of this fuel injector 7. The atomization of the fuel is promoted by the assist air ejected from this assist air feeding port 8 toward the injected fuel. An air flow control valve 9 is arranged inside the intake branch pipe 5 upstream of the nozzle port and assist air feeding port 8 of the fuel injector 7. On the other hand, the surge tank 6 is connected to an air cleaner (not illustrated) via an intake duct 10. A throttle valve 11 is arranged in this intake duct 10.

A bypass passage 12 is branched from the intake duct 10 upstream of the throttle valve 11. This bypass passage 12 is connected on the one hand to a bypass passage 14 communicated with the interior of the intake duct 10 downstream of the throttle valve 11 via an idling speed control valve 13 and connected on the other hand to an assist air passage 15 communicated with the assist air feeding port 8 via the idling speed control valve 13. The idling speed control valve 13 provides a rotary valve 16 comprising a first valve body 16*a* controlling a communication area between the bypass passage 12 and the assist air passage 15, that is, an opening area A of the assist air passage 15, and a second valve body 16*b* controlling a communication area between the bypass passage 12 and the bypass passage 14, that is, an opening area S of the bypass passage 14. A permanent magnet 17 is attached to an end portion of a valve shaft of this rotary valve 16. Electromagnet coils 18 are arranged on the two sides of the permanent magnet 17.

Figure 2:
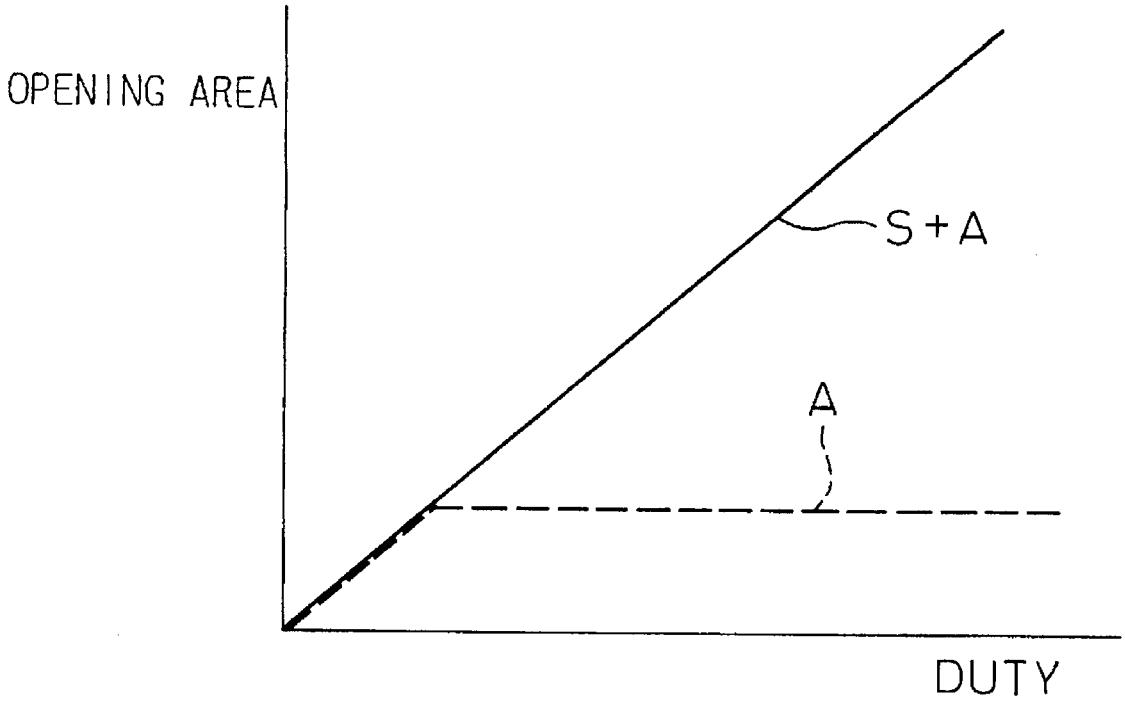
FIG. 2 is a view showing an opening area of an idling speed control valve.

A pulse current is fed to these electromagnet coils 18. The proportion of the time for generating the pulse current to the generation cycle of the pulse current, that is, the duty ratio of the pulse current, is controlled. FIG. 2 shows the relationship among a duty ratio DUTY of the pulse current, the opening area A of the assist air passage 15, and the opening area S of the bypass passage 14. Note that, in FIG. 2, the broken line indicates the opening area A of the assist air passage 15, and the solid line indicates the sum of the opening area A of the assist air passage 15 and the opening area S of the bypass passage 14. Accordingly, it is seen from FIG. 2 that when the duty ratio DUTY is small, only the opening area A of the assist air passage 15 is increased along with the increase of the duty ratio DUTY, while when the duty ratio DUTY becomes large, the opening area A of the assist air passage 15 is maintained constant and the opening area S of the bypass passage 14 is increased along with the increase of the duty ratio DUTY.

As shown in FIG. 1, the end portion of an arm 19 attached to the valve shaft of the air flow control valve 9 is connected to a vacuum operated diaphragm type drive device 21 via a rod 20. This vacuum operated diaphragm type drive device 21 is provided with a pair of diaphragms 23 and 24 connected to each other via a rod 22. A negative pressure chamber 25 of the diaphragm 23 is connected to the interior of the intake branch pipe 5 via a switching valve 26 which can be communicated with the outside air and a check valve 27 which allows flow of air only toward the interior of the intake branch pipe 5. A vacuum chamber 28 of the diaphragm 24 is connected to a vacuum tank 30 via a switching valve 29 which can be communicated with the outside air. The vacuum tank 30 is connected to the interior of the intake duct 10 via a check valve 31 which allows flow of air only toward the interior of the intake duct 10. Accordingly the interior of the vacuum tank 30 is maintained at the maximum vacuum generated inside the intake duct 10 downstream of the throttle valve 11.

When the vacuum chambers 25 and 28 are opened to the outside air by the switching valves 26 and 29, as shown in FIG. 1, the air flow control valve 9 is in the closed state. In the embodiment shown in FIG. 1, a slight air flow gap is formed at the circumferential edge of the air flow control valve 9. Accordingly even if the air flow control valve 9 is in the closed state, the intake air slightly flows past the periphery of the air flow control valve 9. When the vacuum chamber 25 is connected to the interior of the intake branch pipe 5 by the switching action of the switching valve 26, vacuum is generated in the vacuum chamber 25. At this time, the rod 20 is pulled downward by the rod 22. At this time, the air flow control valve 9 becomes half-opened. On the other hand, when the vacuum chamber 25 is connected to the interior of the vacuum tank 30 by the switching action of the switching valve 29, the rod 20 is further pulled downward. At this time, the air flow control valve 9 becomes fully open.

An electronic control unit 40 comprises a digital computer and is provided with a read only memory (ROM) 42, a random access memory (RAM) 43, a CPU (microprocessor) 44, an input port 45, and an output port 46 which are connected to each other by a bidirectional bus 41. A temperature sensor 47 for detecting an engine cooling water temperature is connected to the input port 45 via an analog-to-digital (AD) converter 48, and further an engine speed sensor 49 for detecting the engine speed is connected to the input port 45. Further, although not illustrated in the figure, an air flow meter for detecting the amount of intake air or a pressure sensor for detecting an absolute pressure in the surge tank 6 is connected to the input port 45. On the other hand, an output port 46 is connected to the electromagnet coils 18 and the switching valves 26 and 29 via corresponding drive circuits 50.

Figure 3:
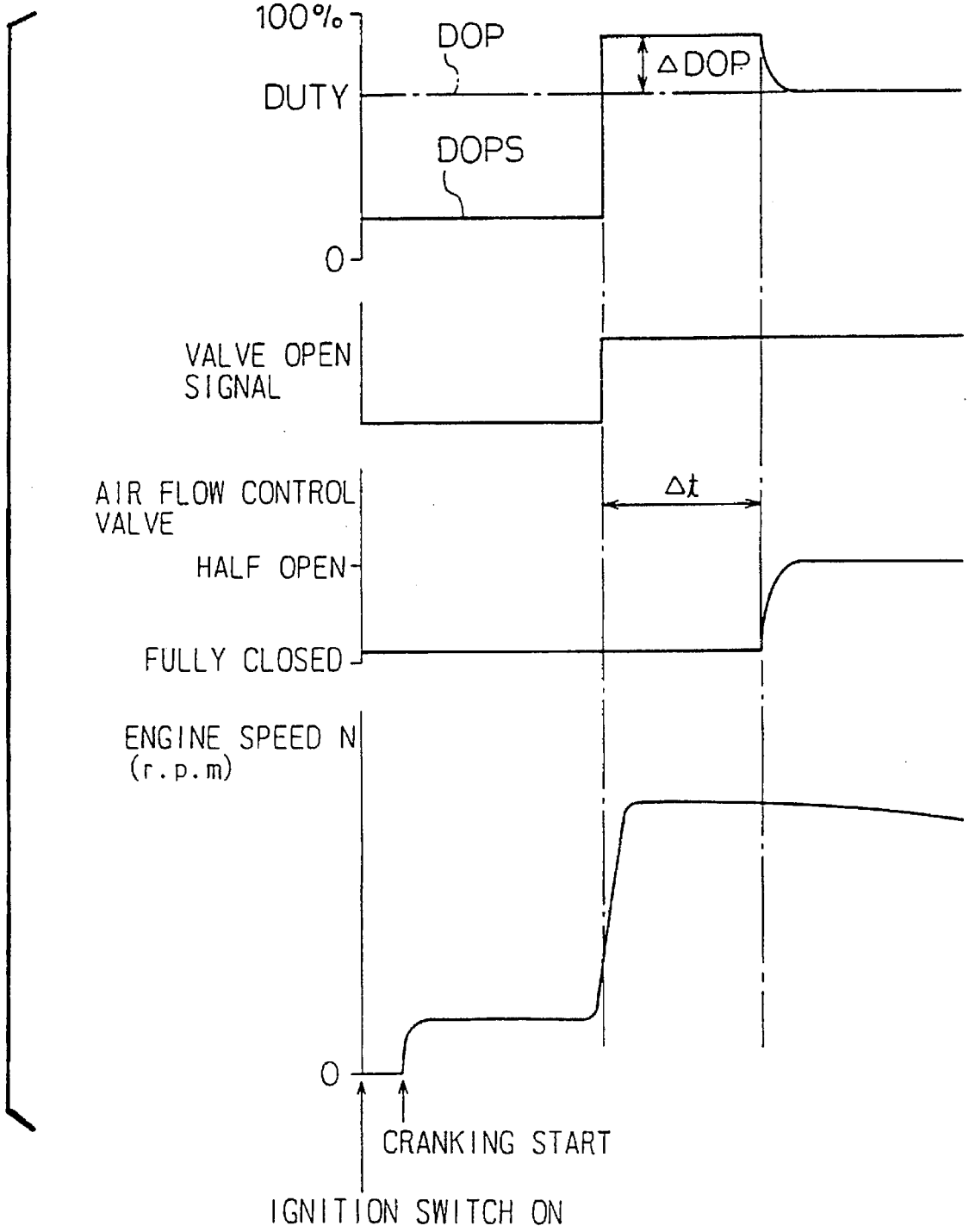
FIG. 3 is a timing chart showing a degree of opening of the air flow control valve when the engine is started.

FIG. 3 shows the control of the duty ratio DUTY at the start of the engine etc. Referring to FIG. 3, when the ignition switch is turned on, the duty ratio DUTY of the pulse current fed to the electromagnetic coil 18 is brought to a start time duty ratio DOPS. This start time duty ratio DOPS is determined based on for example the engine cooling water temperature so that the minimum amount of assist air amount which can atomize the injected fuel is obtained. Further, at this time, the vacuum chambers 25 and 28 of the vacuum operated diaphragm device 21 are opened to the outside. Accordingly, the air flow control valve 9 is in the closed state.

Subsequently, the cranking is started. Also at this time, the duty ratio DUTY is brought to the start time duty ratio DOPS, and the air flow control valve 9 is held in the closed state. When the cranking is started, a small amount of air is fed from the assist air feeding port 8. At this time, the inflow of the intake air from the intake branch pipe 5 is suppressed by the air flow control valve 9. Accordingly, when the intake valve 3 is opened at this time, a great vacuum is generated in the intake port 4, and the amount of the intake air fed into the engine cylinder becomes small. Accordingly, at this time, an amount of fuel corresponding to the small amount of intake air is injected from the fuel injector 7, so the amount of the injected fuel becomes small. Further, at this time, a great vacuum is generated in the intake port 4, so the vaporization of the injected fuel is promoted and further the atomization of the injected fuel is promoted by the assist air fed from the assist air feeding port 8. Thus, the amount of emission of the unburned hydrocarbons is greatly reduced.

Subsequently, when the engine speed N exceeds the predetermined engine speed, for example, 400 rpm, the valve open signal for the air flow control valve 9 is given to the vacuum operated diaphragm type drive device 21, and the switching action of the switching valve 26 is carried out so as to connect the vacuum chamber 25 to the interior of the intake branch pipe 5. When the vacuum chamber 25 is connected to the interior of the intake branch pipe 5, the air flow control valve 9 is half opened, but there is a delay of action in the vacuum operated diaphragm type drive device 21. Accordingly, as shown in FIG. 3, after a certain delay period $\Delta t$ has elapsed from when the valve open signal is given, the air flow control valve 9 actually becomes half-opened.

On the other hand, as shown in FIG. 3, simultaneously with when the valve open signal for the air flow control valve 9 is given to the vacuum operated diaphragm type drive device 21, the duty ratio DUTY is abruptly raised to a value larger than the target duty ratio DOP exactly by an amount ΔDOP, whereby an opening area (S+A) shown in FIG. 2 is increased. Here, the target duty ratio DOP is a duty ratio DUTY that can maintain the engine speed at the lower limit engine speed with which a good combustion is obtained that is, at the target engine speed after the engine is started. This target duty ratio DOP is preliminarily stored in the ROM 42 in the form of a function of for example the engine cooling water temperature.

On the other hand, ΔDOP is a correction amount of the duty ratio DUTY which is necessary for compensating for the amount of air lacking since the air flow control valve 9 is not half-opened. This correction amount ΔDOP of the duty ratio DUTY is preliminarily found by experiment. As shown in FIG. 3, this duty ratio correction amount ΔDOP is added to the target duty ratio DOP during an opening delay period Δt of the air flow control valve 9, whereby the flow area of the flow path of the air fed to the intake passage upstream and downstream of the air flow control valve 9 or the intake passage upstream of the air flow control valve 9 is increased. Subsequently, when the air flow control valve 9 is actually opened, the duty ratio correction amount ΔDOP is reduced to zero along with this. In this way, in the embodiment shown in FIG. 1, the amount of air lacking since the air flow control valve 9 is not half-opened when the valve open signal for the air flow control valve 9 is given to the vacuum operated diaphragm type drive device 21 is compensated by an increase of the duty ratio DUTY exactly by a correction amount ΔDOP. Accordingly, even if the air flow control valve 9 is held in the closed state, the engine speed N smoothly rises to the target engine speed. As a result, a good start feeling is obtained and in addition misfiring is not caused. Accordingly the amount of emission of the unburned hydrocarbons can be suppressed to the minimum level.

The valve opening delay period Δt of the air flow control valve 9 can be found from experiments. Accordingly, in the embodiment shown in FIG. 1, the correction amount ΔDOP is added to the target duty ratio DOP from when the valve open signal is issued to when the valve opening delay period Δt found by experiments has elapsed. Further, the change of the degree of opening from when the air flow control valve 9 changes from the closed state to the half-opened state, that is, the change of the amount of intake air, is found in advance by experiments as well. Also, the pattern of change of the correction amount ΔDOP with which the fluctuation of the amount of intake air is not caused during a period in which the air flow control valve 9 becomes half-opened in state from the closed state is found in advance by experiments. This pattern of change of the correction amount ΔDOP found by experiments is preliminarily stored in the ROM 42. When the valve opening delay period Δt of the air flow control valve 9 has elapsed, the correction amount ΔDOP is reduced to zero according to this pattern of change stored in the ROM 42.

Figure 4A:
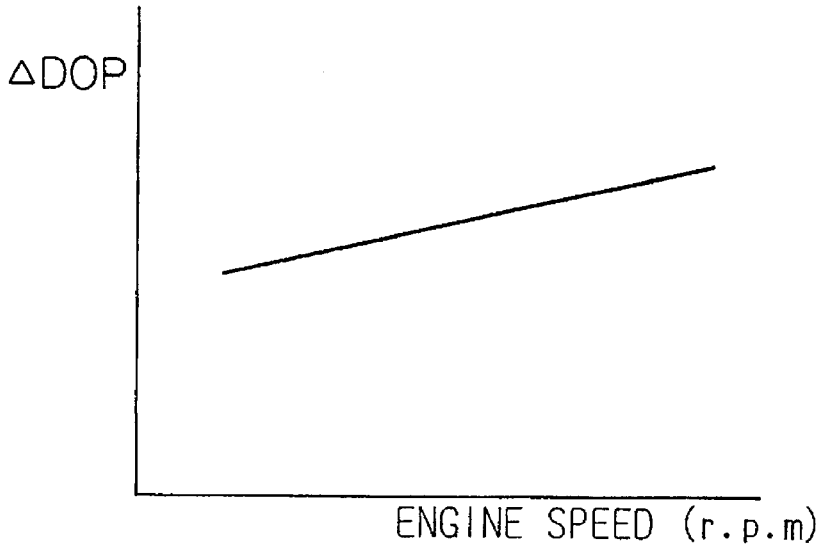
FIGS. 4A and 4B are views showing a correction amount ΔDOP.
Figure 4B:
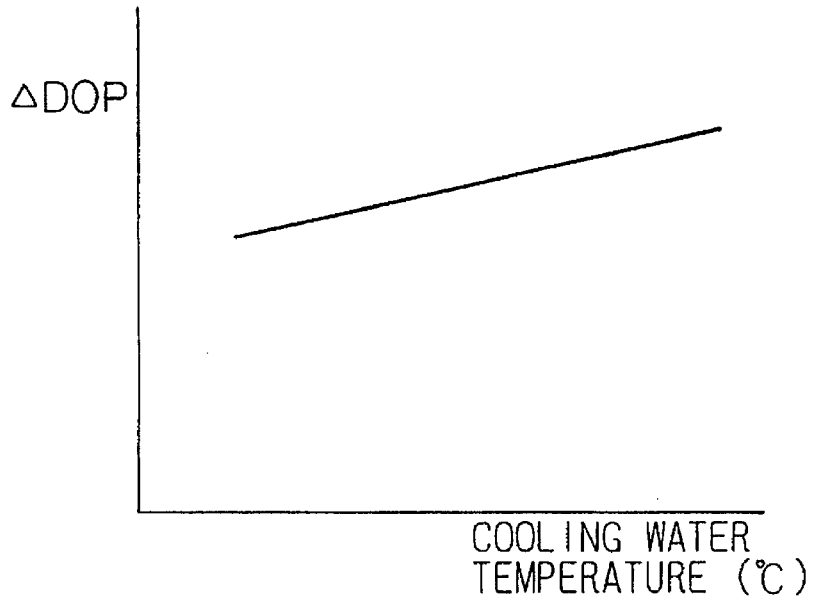

Note that, immediately after the start of the engine, that is, during the valve opening delay period Δt of the air flow control valve 9, the state of combustion is greatly affected by the amount of the intake air. Accordingly, preferably the amount of the intake air is precisely controlled as much as possible immediately after the start of the engine. Immediately after the start of the engine, the higher the engine speed, the more the amount of the intake air fed per cylinder is reduced. Accordingly, immediately after the start of the engine, as shown in FIG. 4A, it can be said that preferably the correction amount ΔDOP is made larger as the engine speed becomes higher. Further, the higher the engine cooling water temperature immediately after the start of the engine, the lower the viscosity of the lubricant oil, so the lower the frictional resistance of the different parts. Accordingly, the higher the engine cooling water temperature, the lower the engine speed immediately after the start of the engine. Accordingly, as shown in FIG. 4B, the higher the engine cooling water temperature, the larger the correction amount ΔDOP can be made.

After the start of the engine, the switching valve 29 is controlled in accordance with the amount of the intake air. When the amount of the intake air is large, the air flow control valve 9 is fully opened, and when the amount of the intake air is small, the air flow control valve 9 is held in the half-opened state. When the air flow control valve 9 is in tile half-opened state, the intake air is guided by the air flow control valve 9 and passed at a high speed along the upper inner wall surface of the intake branch pipe 5, whereby the atomization of the injected fuel is promoted.

Figure 5:
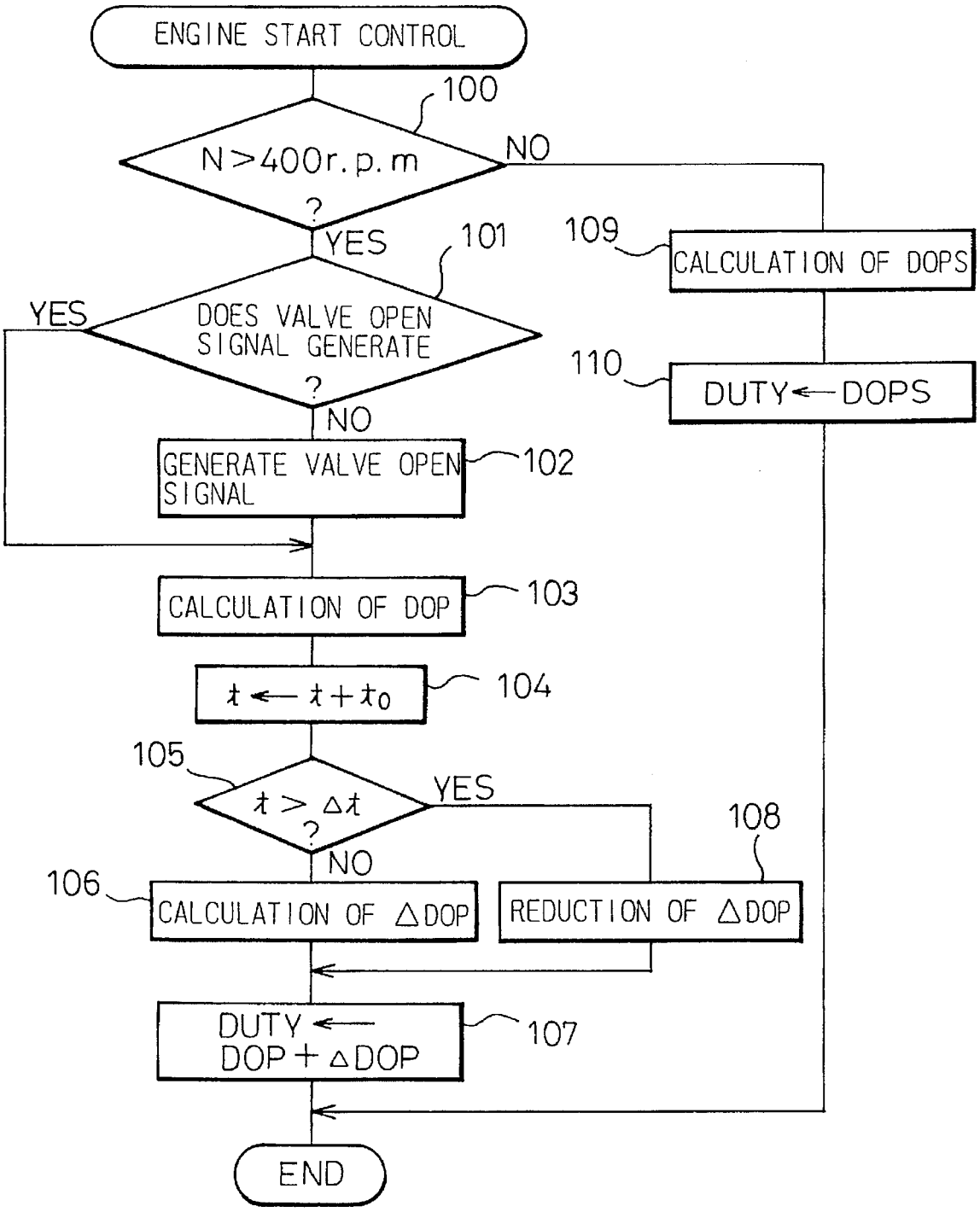
FIG. 5 is a flowchart of the control of the start of the engine.

FIG. 5 shows a start control routine of the engine. This routine is executed by interruption at every predetermined time interval.

Referring to FIG. 5, first of all, it is decided at step 100 whether or not the engine speed N has become higher than the predetermined engine speed, for example 400 rpm. When N≦400 rpm, the operation routine proceeds to step 109, at which the start time duty ratio DOPS is found, and then at step 110, this start time duty ratio DOPS is brought to the duty ratio DUTY. Contrary to this, when N becomes larger than 400 rpm, the operation routine proceeds to step 101, at which it is decided whether or not the valve open signal for the air flow control valve 9 has been generated. When the valve open signal has not been generated, the operation routine proceeds to step 102, at which the valve open signal is generated. Then, the operation routine proceeds to step 103. Once the valve open signal is generated, the operation routine jumps from step 101 to step 103 from the next processing cycle.

At step 103, the target duty ratio DOP is calculated. Then, at step 104, by adding the interruption time interval $t_0$ to t, an elapsed time t from when the valve open signal is generated is calculated. Then, at step 105, it is decided whether or not this elapsed time t exceeds the valve opening delay period Δt (FIG. 3) of the air flow control valve 9. When t≦Δt, the operation routine proceeds to step 106, at which the correction amount ΔDOP is calculated, and then, at step 107, by adding the correction amount ΔDOP to the target duty ratio DOP, the duty ratio DUTY is calculated. Contrary to this, when t becomes larger than Δt, the operation routine proceeds to step 108, at which the correction amount ΔDOP is reduced to zero so that the amount of intake air does not fluctuate according to the pattern of change stored in the ROM 42.

Figure 6:
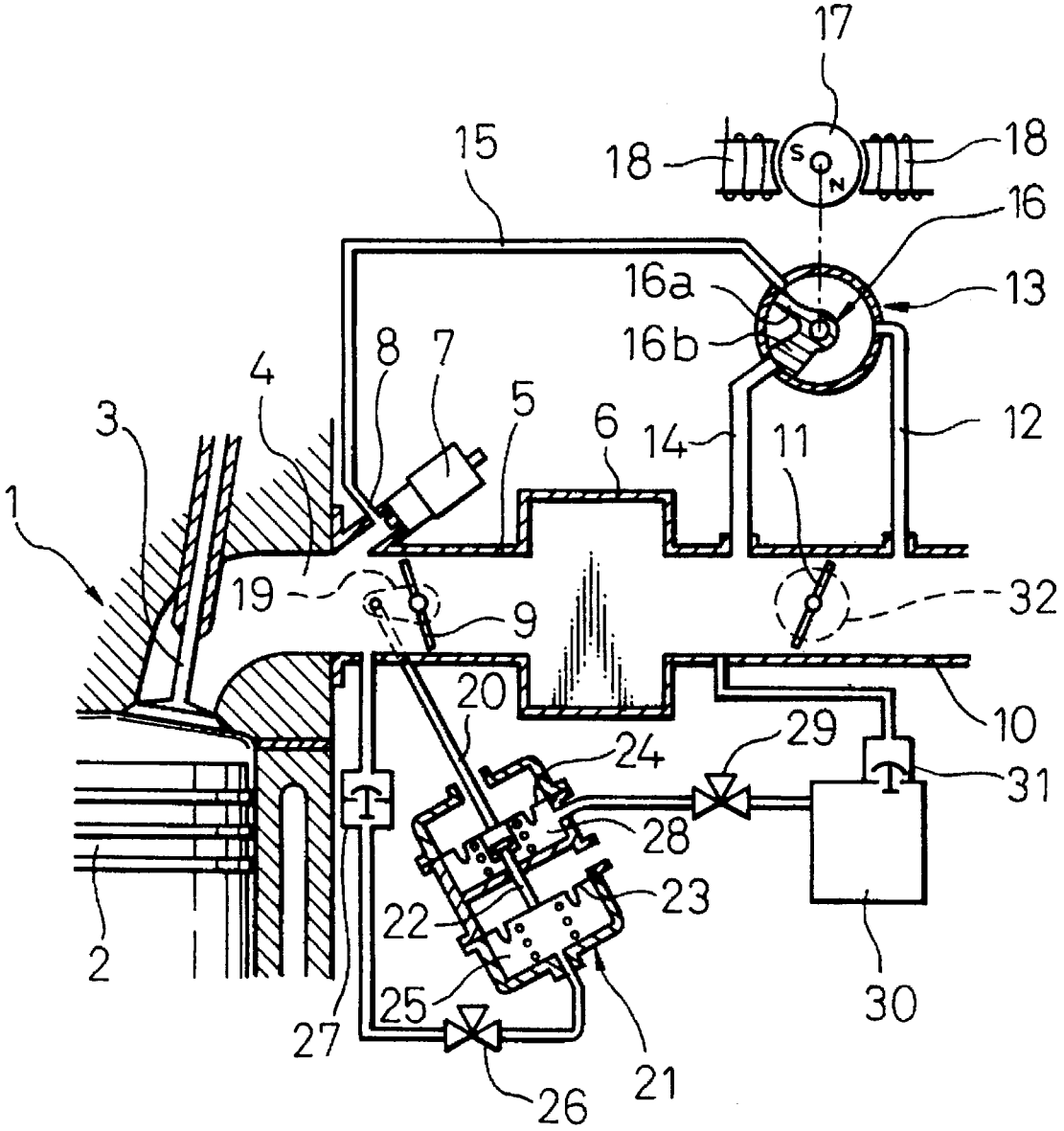
FIG. 6 is an overall view showing another embodiment of the engine.
Figure 7:
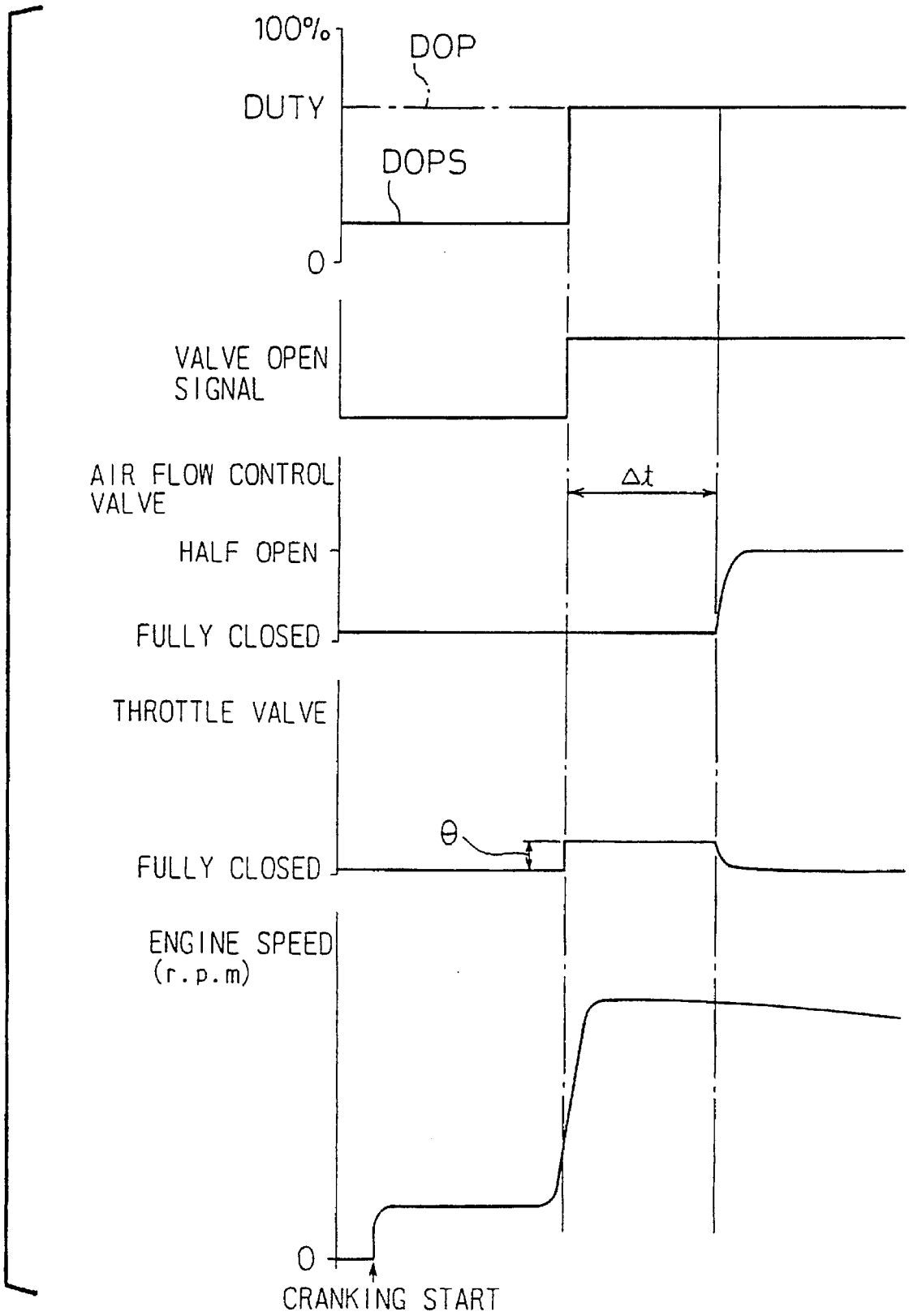
FIG. 7 is a timing chart showing the degree of opening of the air flow control valve when the engine is started etc.
Figure 8:
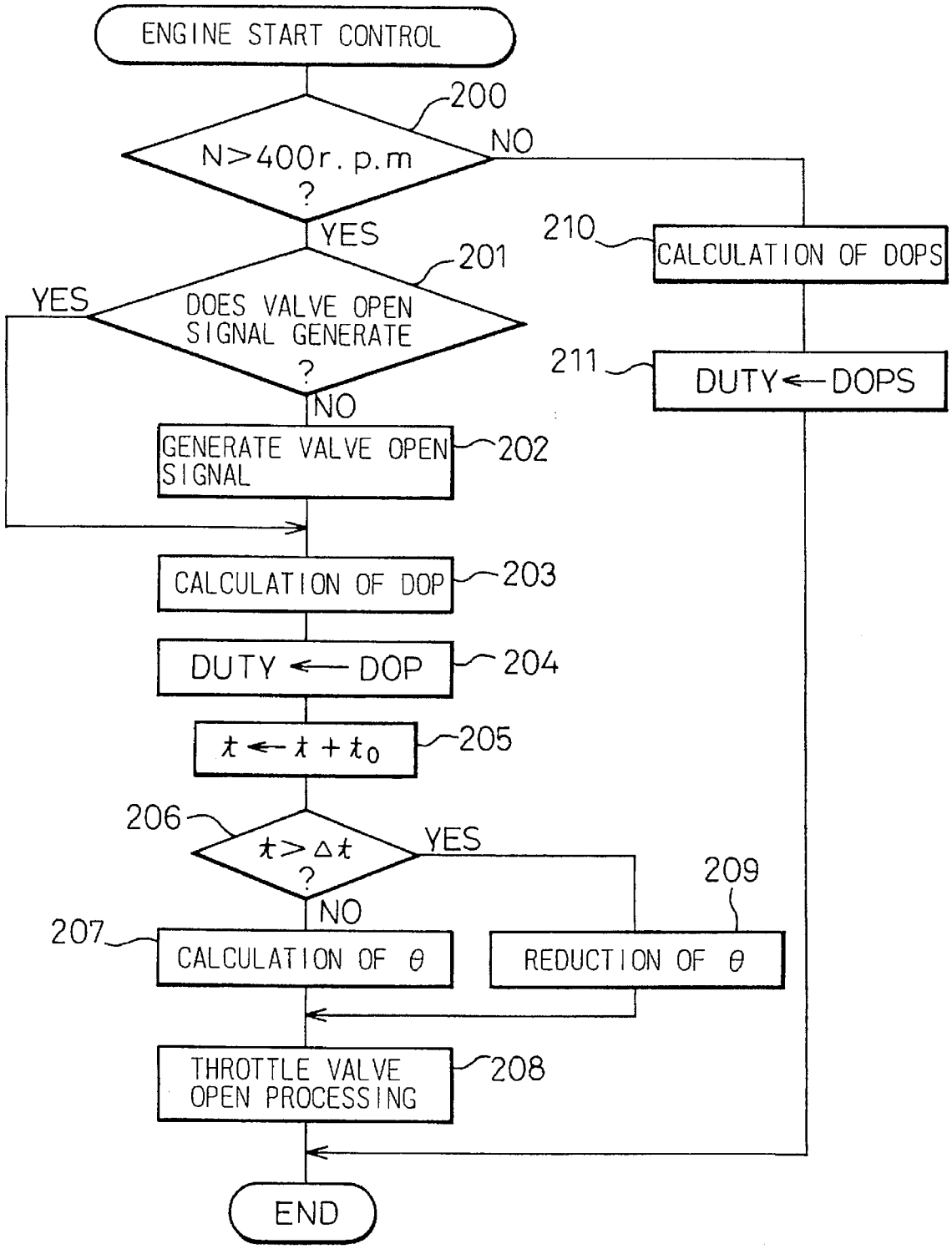
FIG. 8 is a flowchart of the control of the start of the engine.

FIG. 6 to FIG. 8 show another embodiment. In this embodiment, as shown in FIG. 6, the throttle valve 11 is driven by an actuator 32 comprising for example a DC motor. Usually, the actuator 32 is driven in accordance with the amount of depression of the accelerator pedal to control the throttle valve 11. In this embodiment, by utilizing this actuator 32, during the valve opening delay period Δt of the air flow control valve 9, the throttle valve 11 is opened, whereby the flow area of the flow path of the air fed into the intake passage upstream of the air flow control valve 9 is increased. Namely, as shown in FIG. 7, in this embodiment, when the valve open signal for the air flow control valve 9 is generated, the duty ratio DUTY is abruptly raised from the start time duty ratio DOPS to the target duty ratio DOP, and simultaneously, the throttle valve 11 is opened from the fully closed state exactly by an angle θ. This angle θ is a degree of opening necessary for compensating for the amount of air lacking since the air flow control valve 9 is not half-opened. This opening degree θ is preliminarily found by experiment.

FIG. 8 shows the start control routine of the engine. This routine is executed by interruption at every predetermined time interval.

Referring to FIG. 8, first of all, it is decided at step 200 whether or not the engine speed N becomes higher than the predetermined engine speed, for example, 400 rpm. When N≦400 rpm, the operation routine proceeds to step 210, at which the start time duty ratio DOPS is found, and then at step 211, this start time duty ratio DOPS is brought to the duty ratio DUTY. Contrary to this, when N becomes larger than 400 rpm, the operation routine proceeds to step 201, at which it is decided whether or not the valve open signal for the air flow control valve 9 is generated. When the valve open signal has not been generated, the operation routine proceeds to step 202, at which the valve open signal is generated. Then, the operation routine proceeds to step 203. Once the valve open signal is generated, the operation routine jumps from step 201 to step 203 from the next processing cycle.

At step 203, the target duty ratio DOP is calculated, then at step 204, this target duty ratio DOP is brought to the duty ratio DUTY. Then, at step 205, by adding the interruption time interval $t_0$ to t, an elapsed time t from when the valve open signal is generated is calculated. Then, at step 206, it is decided whether or not this elapsed time t exceeds the valve opening delay period Δt (FIG. 7) of the air flow control valve 9. When t≦Δt, the operation routine proceeds to step 207, at which the opening degree 8 of the throttle valve 11 which should be opened is calculated, and then at step 208, the valve opening processing of the throttle valve 11 is carried out. Contrary to this, when t becomes larger than Δt, the operation routine proceeds to step 209, at which the throttle opening degree θ is reduced to zero so that the amount of intake air does not fluctuate according to the pattern of change stored in the ROM 42.

As mentioned above, according to the present invention, the engine speed can be smoothly raised while suppressing the discharge of the unburned hydrocarbons at the start of the engine.

While the invention has been described by reference to specific embodiments chosen for purposes of illustration, it should be apparent that numerous modifications could be made thereto by those skilled in the art without departing from the basic concept and scope of the invention.

We claim:

1. An air flow control device of an engine having an intake passage comprising:

a throttle valve arranged in the intake passage;

an air flow control valve arranged in the intake passage downstream of said throttle valve;

drive means for driving said air flow control valve;

control means for controlling said drive means to retain said air flow control valve in a closed state when the cranking operation of the engine is carried out and to give a valve open signal for said air flow control valve to said drive means when the engine speed exceeds a predetermined speed; said drive means opening said air flow control valve when a predetermined time has elapsed after said valve open signal is given to said drive means, due to the delay of action of said drive means; and flow area increasing means for increasing a flow area of an air flow passage by which air is fed into the intake passage downstream of said throttle valve until said predetermined time has elapsed after said valve open signal is given to said drive means.

2. An air flow control device according to claim 1, wherein said drive means comprises a vacuum operated diaphragm type drive device.

3. An air flow control device according to claim 2, wherein: said vacuum operated diaphragm type drive device is provided with a diaphragm connected to said air flow control valve, a vacuum chamber defined by the diaphragm, and a switching valve arranged between the vacuum chamber and a vacuum generating region in the intake passage; and said switching valve is switched when said valve open signal is given to said drive means.

4. An air flow control device according to claim 2, wherein said vacuum operated diaphragm type drive device is provided with a pair of diaphragms connected to said air flow control valve, a pair of vacuum chambers defined by the respective diaphragms, and a pair of switching valves respectively arranged between the respective vacuum chambers and the vacuum generating region in the intake passage; when a vacuum is generated in the interior of one vacuum chamber by the switching action of said switching valve, said air flow control valve becomes a half-opened state, and when a vacuum is generated in the interior of both vacuum chambers, said air flow control valve becomes the fully opened state.

5. An air flow control device according to claim 4, wherein when said valve open signal is given to said drive means, one of said switching valves is switched and said air flow control valve becomes the half-opened state.

6. An air flow control device according to claim 1, wherein a fuel injector is arranged in the intake passage downstream of said air flow control valve.

7. An air flow control device according to claim 1, wherein said flow area increasing means is provided with a motor electrically driven, and the flow area of said air flow passage is controlled by said motor.

8. An air flow control device according to claim 1, wherein an upstream end of said air flow passage is connected to the intake passage upstream of said throttle valve; a downstream end of said air flow passage is connected to the intake passage downstream of said throttle valve; and said flow area controlling means is provided with a flow area control valve for controlling the flow area of said air flow passage.

9. An air flow control device according to claim 8, wherein the downstream end of said air flow passage is connected to the interior of the intake passage downstream of said air flow control valve.

10. An air flow control device according to claim 9, wherein the fuel injector is arranged in the intake passage downstream of said air flow control valve; and the downstream end of said air flow passage is directed to a nozzle port of the fuel injector.

11. An air flow control device according to claim 8, wherein said air flow passage is branched to a first flow path and a second flow path at an intermediate portion thereof; the downstream end of said first flow path is connected to the intake passage downstream of said air flow control valve; and the downstream end of said second flow path is connected to the intake passage between said throttle valve and said air flow control valve.

12. An air flow control device according to claim 11, wherein the fuel injector is arranged in the intake passage downstream of said air flow control valve; and the downstream end of said first flow path is directed to the nozzle port of the fuel injector.

13. An air flow control device according to claim 11, wherein said flow area control valve controls the flow area of said first flow path and the flow area of said second flow path.

14. An air flow control device according to claim 13, wherein said flow area control valve closes the second flow path when controlling the flow area of the first flow path and fully opens the first flow path when controlling the flow area of the second flow path.

15. An air flow control device according to claim 8, wherein said flow area increasing means increases the degree of opening of said flow area control valve exactly by a predetermined opening degree until said predetermined time has elapsed after said valve open signal is given to said drive means.

16. An air flow control device according to claim 15, wherein the higher the engine speed, the larger said predetermined opening degree.

17. An air flow control device according to claim 15, wherein the higher the engine cooling water temperature, the larger said predetermined opening degree.

18. An air flow control device according to claim 15, wherein opening degree control means is provided for raising the opening degree of said flow area control valve to the target opening degree when the engine speed exceeds said predetermined engine speed; and said flow area increasing means increases the degree of opening of said flow area control valve exactly by a predetermined opening degree with respect to said target opening degree until said predetermined time has elapsed after said valve open signal is given to said drive means.

19. An air flow control device according to claim 1, wherein said air flow passage is formed between said throttle valve and the inner wall surface of the intake passage; and said flow area control means controls the flow area of said air flow passage by controlling the opening degree of the throttle valve.

20. An air flow control device according to claim 19, wherein said flow area increasing means increases the degree of opening of said throttle valve exactly by a predetermined opening degree until said predetermined time has elapsed after said valve open signal is given to said drive means.

21. An air flow control device according to claim 19, wherein said device comprises: a bypass passage for connecting the intake passage upstream of said throttle valve and the intake passage downstream of the throttle valve; an air flow control valve arranged in said bypass passage; and opening degree control means for raising the opening degree of said air flow control valve to the target opening degree when the engine speed exceeds said predetermined engine speed.

* * * * *